United States Patent [19]

Denoor et al.

[11] 4,323,200

[45] Apr. 6, 1982

[54] APPARATUS AND METHOD FOR WINDING AN ELONGATE MEMBER ONTO A BODY UNDER TENSION

[75] Inventors: Gaston Denoor; Georges Thillet, both of Grenoble, France

[73] Assignee: B.V.S., Grenoble, France

[21] Appl. No.: 33,220

[22] Filed: Apr. 25, 1979

Related U.S. Application Data

[63] Continuation-in-part of Ser. No. 805,607, Jun. 10, 1977, abandoned.

[30] Foreign Application Priority Data

Sep. 17, 1976 [FR] France ..... 76 28032

[51] Int. Cl.[3] ..... B21F 17/00

[52] U.S. Cl. ..... 242/7.21

[58] Field of Search ..... 242/7.21, 7.22, 7.23, 242/7.02, 155

[56] References Cited

U.S. PATENT DOCUMENTS

| | | | |
|---|---|---|---|
| 2,785,866 | 3/1957 | Vogt | 242/7.21 |
| 3,572,596 | 3/1971 | Dykmans | 242/7.21 |
| 3,666,190 | 5/1972 | Dykmans | 242/7.21 |
| 3,687,380 | 8/1972 | Magers et al. | 242/7.21 |
| 3,773,270 | 11/1973 | Brandestini | 242/7.21 |
| 4,002,304 | 1/1977 | Peszeszer | 242/7.21 |
| 4,120,209 | 10/1978 | Vogt | 242/7.21 |

*Primary Examiner*—Billy S. Taylor

*Attorney, Agent, or Firm*—Haseltine and Lake

[57] ABSTRACT

A method and apparatus for winding an elongate member, such as a strip or wire, under tension around a body comprising a frame maintained at a preset distance from the body and movable around the body by means including a belt held against rotation relative to the body and two belt engaging members each selectively adapted to be clamped against and released from the belt. One of the belt engaging members is fixed relative to the frame and the other of the members is movable relative to the frame in a first direction when the one member is engaged with the belt and in the opposite direction when the other member is engaged with the belt to move the frame relative to the body. The frame carries a guide for guiding the elongate member onto the body and a mechanism for tensioning the strip as it is wound on the body.

14 Claims, 16 Drawing Figures

Fig. 1
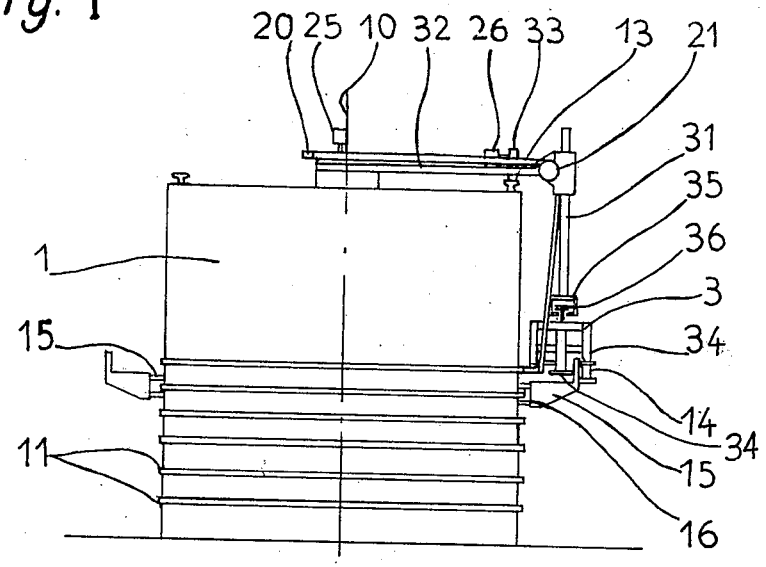
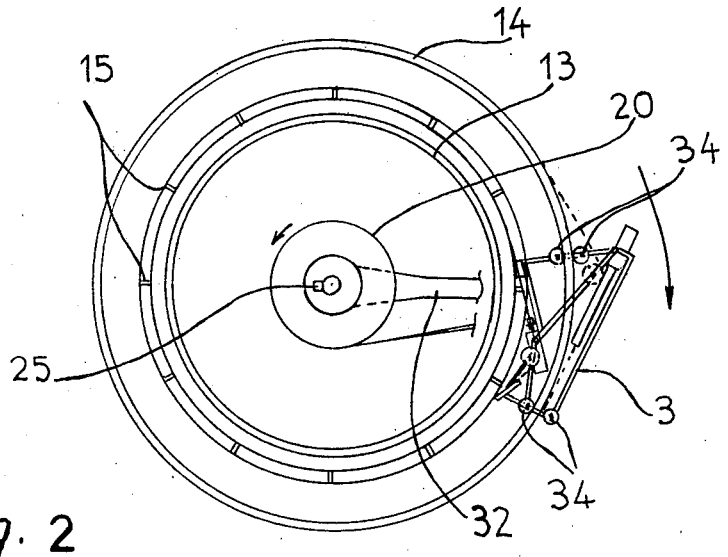
Fig. 2

APPARATUS AND METHOD FOR WINDING AN ELONGATE MEMBER ONTO A BODY UNDER TENSION

CROSS-RELATED APPLICATION

This Application is a continuation-in-part of Ser. No. 805,607 filed June 10, 1977, now abandoned.

FIELD OF THE INVENTION

The invention relates to a device for winding an elongate member, such as a wire, a cable, a strip or the like under tension onto a cylindrical body.

The invention is particularly applicable, but not exclusively, for use in the production of enclosures intended to withstand high internal pressures. When such enclosures are of large dimensions, it is economical to make them from concrete, but the concrete cannot by itself withstand the high internal pressure. Enclosures have been produced from pre-stressed concrete, but the apparatus for pre-stressing and tensioning the concrete poses difficult problems.

PRIOR ART

A long time ago it was proposed to reinforce cylindrical enclosures of concrete externally by winding thereon an elongate member, such as a wire, the winding being carried out under considerable tension. A machine of this type is described, for example, in U.S. Pat. No. 2,785,866. In such a machine, the wire is wound on a storage reel which may be located, for example, at the top part of the cylindrical body. In being unwound from the reel, the wire is guided by a number of wheels to a frame which is held along a median plane perpendiuclar to the generatrices of the cylindrical body and at a constant distance from the wall. In U.S. Pat. No. 2,785,866, the frame is supported by a column which is parallel with the generatrices of the body and the column, in turn, is mounted at the end of an arm which turns about the axis of the cylindrical body and may bear thereon. Hence, winding of the strip is produced by rotation of the arm about the axis of the body. One end of the wire is attached to the body and rotation of the frame produces winding of the wire in superimposed turns or helicoidally on the body if the height of the frame is varied continuously during the rotation. The wire is put under tension when the frame exerts a force upon the wire being wound, the tangential speed of winding from the reel being then less than the tangential speed of winding onto the cylindrical body because of elongation of the wire. Numerous devices have been proposed for tensioning the wire and for controlling the tension. All these devices have the disadvantage of requiring relatively large and rather heavy equipment in which the movement of the frame around the body and the tensioning of the wire uses a relatively high power.

SUMMARY OF THE INVENTION

In accordance with the invention there is provided a device for winding an elongate member, such as a wire or strip, under tension onto a body, the device comprising a frame, guide means mounted on the frame for guiding the elongate member to the body, means for maintaining said frame at a constant distance from the body, means for displacing said frame around the body to wind said elongate member onto the body, and means for controlling the tension in said elongate member as it is wound onto the body, said frame displacing means including a belt surrounding said body and fixed against rotation relative thereto, first and second means for engaging said belt, each selectively movable relative to said belt to engage or release said belt, said first belt engaging means being mounted on and fixed relative to said frame and said second belt engaging means being mounted on and movable relative to said frame, and means for moving said second belt engaging means in the direction of winding of the elongate member when said first belt engaging means is engaged with said belt and in the opposite direction when said second belt engaging means is engaged with said belt.

BRIEF DESCRIPTION OF THE SEVERAL VIEWS OF THE DRAWING

The invention will be more fully understood from the following description of an embodiment thereof, given by way of example only, with reference to the accompanying drawing.

In the drawing:

FIG. 1 is a diagrammatic elevational view of a cylindrical body and a winding device in accordance with the invention.

FIG. 2 is a plan view of the apparatus illustrated in FIG. 1.

DETAILED DESCRIPTION

Figure 3:
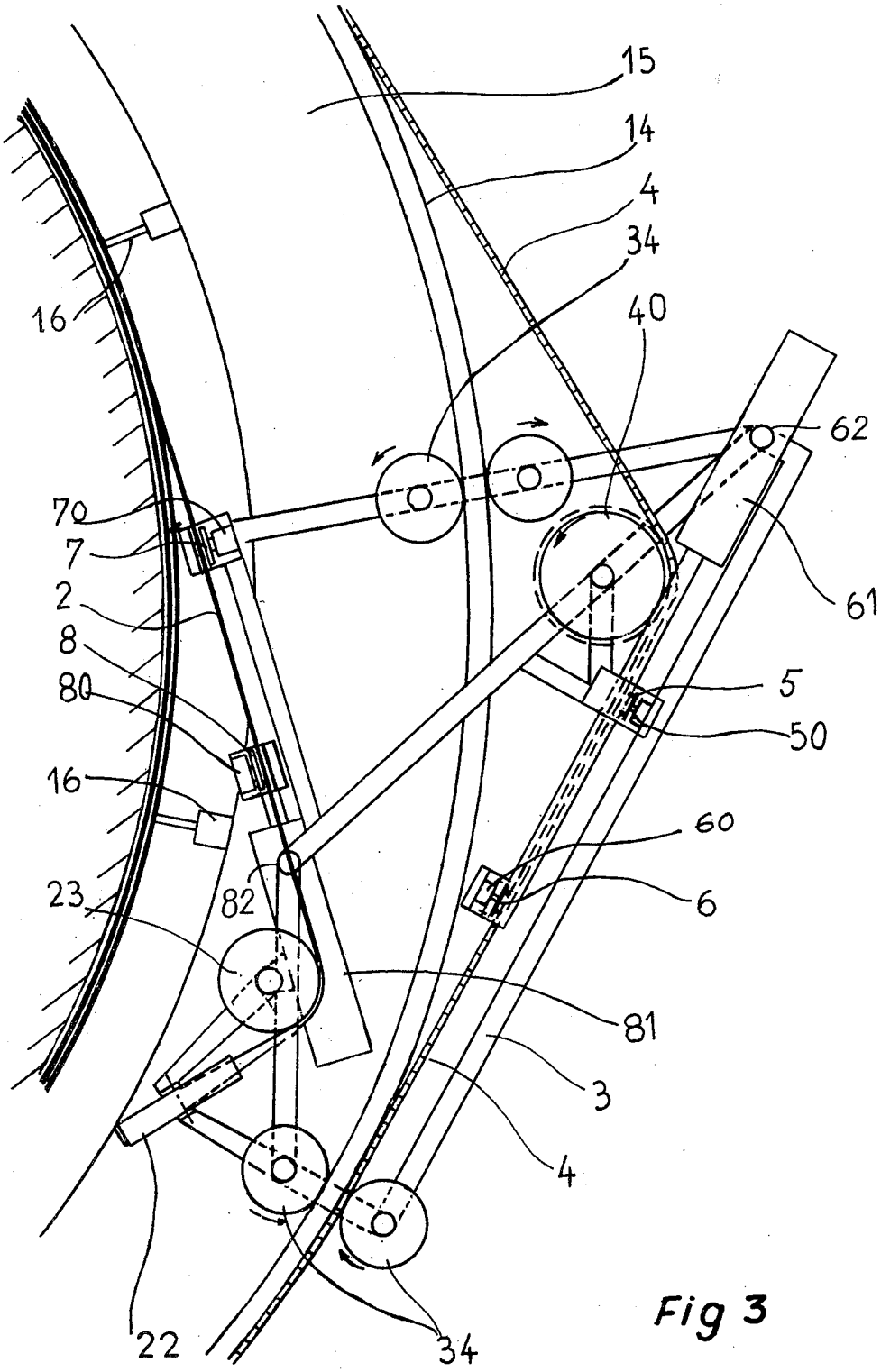
FIG. 3 is a detail view on enlarged scale of the winding device of FIG. 1.

In FIGS. 1 to 3, a cylindrical body 1 is shown, which is reinforced by a plurality of spaced hoops 11. Preferably, each hoop consists of a winding of an elongate member 2 such as a strip, e.g. a metal ribbon, in superimposed turns. However, the device to be described may be employed for winding other elongate members, such as a wire or a cable onto the cylindrical body in helicoidal turns.

The ribbon is wound on a storage reel 20 which is mounted for rotation about the axis 10 of the cylindrical body. The reel 20 preferably contains the entire length of ribbon necessary to the production of one hoop. A winding device for the ribbon is mounted on a frame 3 which is supported by a suspension arm 31 which in turn is mounted at the end of a horizontal arm 32 which is rotatable about the axis 10 of the cylindrical body. As in U.S. Pat. No. 2,785,866, the arm 32 is supported by the cylindrical body 1, for example, by a roller 33 rolling on a circular rail 13 mounted on the top edge of the cylindrical body 1. The length of the arm 31 is adjustable so as to be able to carry out the winding at different heights along the wall of the cylindrical body.

In U.S. Pat. No. 2,785,866, the frame 3 supports pulleys for guiding the ribbons and frame 3 bears directly against the cylindrical body. It is thus possible to keep the frame at a constant distance from the sidewall of the body 1. However, in order to take into account possible defects in the wall of the body and to reduce as much as possible the friction opposing the advance of the frame, it is preferred in the arrangement of the invention to employ a cylindrical wall 14 forming a circular beam which is held and centered on the body 1 at the required height by means of a plurality of jacks 15. The frame 3 carries rollers 34 having vertical axes and located on opposite sides of the wall 14 for bearing against the wall 14 and thus forms a movable assembly which is driven around the wall 14 in successive stepwise displacements in a manner to be explored more fully hereafter by engagement with a belt 4 connected to the body 1 by means of two movable belt-engaging members that can be brought closer together or spaced further apart.

The frame 3 thus exerts no reaction force upon the arm 31 and the latter may be equipped at its lower end with an arcuate hanger beam 35 extending parallel to the wall of the cylindrical body and having a length a little greater than the displacement of the frame at each operation. The hanger beam 35 may have a box section enabling it to be hooked onto a rail 36 of T-section attached to the top portion of the frame 3. In order to reduce the reaction of the frame against the arm 31, the T-section rail 36 may be replaced by rollers rolling on circular tracks arranged on the beam 35.

The frame 3 does not have to withstand bending stress and hence may consist of a relatively light metal structure. Onto this structure are fixed the vertical axles of the rollers 34 located on opposite sides of the wall 14 and bearing against the wall.

The belt 4 extends along the wall 14 in a median plane substantially perpendicular to the generatrices of the cylindrical body. The belt 4 may be composed, for example, of a chain. The belt is applied against the wall 14 along the greater portion thereof, but is separated from the wall at the location of the frame 3 in order to pass around a guide pulley 40 having a vertical axle which is mounted on the frame 3. The position of the axle of the pulley 40 may be adjustable on the frame 3 so that the belt 4 has no slack but is not subject to tension. The pulley 40 may be equipped with teeth meshing with links of the belt 4 when the latter is constructed as a chain, and the pulley 40 may be driven in rotation so as to cause, under certain circumstances, movement of the frame 3 around the cylindrical body by engagement with the belt 4.

The frame 3 carries two clamp members 5, 6 for selectively engaging and locking against the belt 4. The first clamp member 5 is attached to the frame 3. The second clamp member 6 is mounted at the end of the rod of a jack 61 whose cylinder is hinged at 62 to the frame 3 at a point lying on a line tangent to the wall 14 and to the pulley 40. In order to eliminate any risk of bending of the rod of the jack, the jack can be constituted by two identical jacks extending parallel to one another above and below the belt 4 and actuated simultaneously.

The two clamp members 5 and 6 comprise jaws which can be selectively clamped or unclamped on the belt so that one or the other of the clamp members can be locked onto the belt.

The clamp members will be described later in greater detail with reference to FIGS. 7, 7A, 8 and 8A.

The frame 3 can be moved around the cylindrical body 1 by successive stepwise displacement under the control of jack 61 and the clamp members 5 and 6. In this respect, the clamp member 6 is locked onto the belt and upon retraction of the jack 61, the jack 61 and the frame 3 undergo a stepwise advance, and the clamp member 5 which is unlocked on belt 4 is brought closer to the clamp member 6. The clamp member 5 is thereafter locked onto the belt and the clamp member 6 is released. The jack 61 is then extended to move the clamp member 6 away from the clamp member 5 to a new position on the belt where the clamp member 6 is again locked onto the belt. The clamp member 5 is then released and the jack 61 is then retracted to again advance the frame and bring the clamp member 5 closer to the clamp member 6. The operation is repeated successively to advance the frame 3 around the body 1 in steps.

The belt 4 must, of course, be rendered immovable in rotation with respect to the cylindrical body. Since the belt 4 is applied against the wall 14 along the greater portion of its length and as the belt is slightly stretched, the friction of the belt against the wall 14 is sufficient to ensure fixing of the belt by a capstan effect.

As has been mentioned, the elongate reinforcing member, which will usually be a strip of metal ribbon, is wound onto storage reel 20 which is mounted for rotation around the axis 10 of the cylindrical body 1. The ribbon 2 is guided from roll 20 onto the cylindrical body 1 by rotatable guide pulleys 21,22,23. Pulley 21 is mounted at the end of the arm 32 and the pulleys 22 and 23 are mounted on the frame 3. The axle of the pulley 22 is horizontal and the axle of the pulley 23 is arranged so that the ribbon comes to be wound correctly onto the cylindrical body. When it is desired to produce superimposed windings, the pulley 23 is located in the median plane of the winding to be produced, its axle being parallel with the generatrices of the cylindrical body. However, it is also possible to produce helicoidal windings with turns which are contiguous or not, by suitably tilting the axle of the pulley 23, the installation being equipped in known manner with means for control of the length of the arm 31 during the course of rotation of the frame 3.

The displacement of the frame around the cylindrical body controls the winding of the ribbon from the reel 20 and its passage around the guide pulleys 22,23. By taking into account the respective radii of the sidewall of the cylindrical body 1 and of the wall 14, for each speed of approaching movement of the clamp members 5 and 6 along the belt 4 there being a speed of displacement of the strip or ribbon 2 relative to the carriage for which the ribbon is wound without tension. If, however, the winding of the strip is braked, the strip stretches and undergoes an elongation corresponding to the reduction in speed.

This braking of the strip may be obtained in various ways, for example, by acting upon the speed of unwinding of the reel 20. However, the braking is preferably obtained by employment of a strip-engaging clamping assembly which can be locked relative to the strip so that the speed of displacement of the strip is controlled with respect to the frame during rotation of the latter.

The control of the displacement of the clamping assembly of the strip is synchronized with the rotation of the frame, which as has been seen, is effected by successive stepwise displacement.

The clamping assembly of the strip comprises two strip-engaging clamp members 7 and 8 for engaging the strip 2. The clamp member 7 is attached to the frame 3 and the clamp member 8 is mounted at the end of the rod of a jack 81 whose cylinder is hinged at 82 to the frame 3 at a point on a line extending tangent to the sidewall of the body 1 and to the pulley 23.

The two clamp members 7 and 8 include jaws which can be selectively locked and unlocked on the strip. As the strip 2 is being stretched, it is necessary that it always be clamped or locked. For this reason, there is provided means for selective control of the clamp members 7 and 8 so that the strip is always clamped by one or other of the clamp members 7 and 8.

Figure 7A:
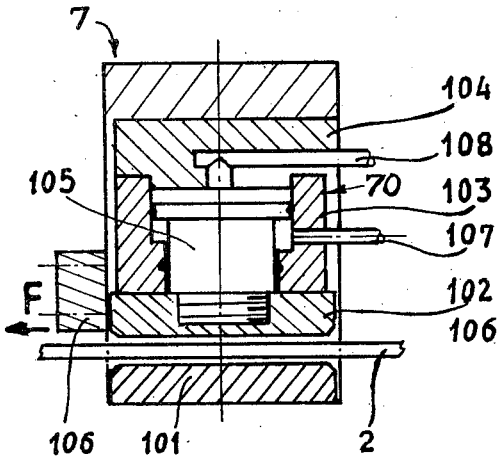
FIG. 7*a* is a sectional view taken along line 7A—7A in FIG. 7.
Figure 7:
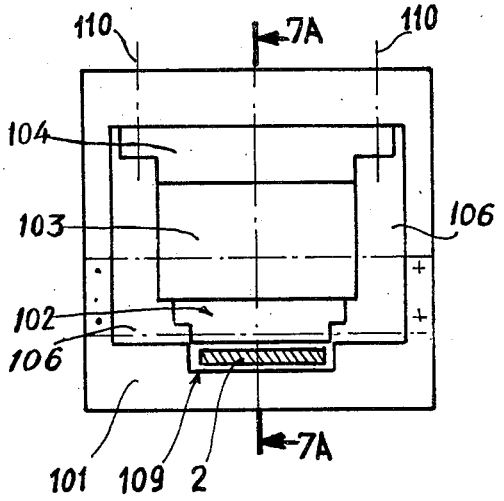
FIG. 7 is an elevation view of a retaining clamp for the reinforcing strip.

In FIGS. 7 and 7A there is shown the construction of clamp member 7 for locking against the reinforcing ribbon which, in the illustrated example, is a strip 2. The construction of clamp member 8 is the same.

The clamp member 7 comprises a casing 101 in the form of a hollow cylinder which is fixed to the frame 3. In the construction of clamp member 8 the casing 101 is fixed to the extremity of the rod of the jack 81. Preferably, the jack 81 is constituted by two identical jacks placed on opposite sides of the strip 2 to avoid bending stress (as has been shown in FIGS. 4 and 6) and in this case, the casing 101 will be fixed to the extremities of the two rods.

The casing is provided with a passage 109 for travel therethrough of strip 2. The lower wall of the casing serves as a counter bearing element or stationary jaw opposite the active jaw constituted by a plate 102 which is actuated by control jack 70 whose cylinder 103 is supported on the upper wall of the casing 101 through the intermediary of a plate 104 fixed to the upper wall. The clamp member 8 is actuated by a jack 80 of the same construction as jack 70. Each of the jacks is a double action jack and includes a piston 105 defining two chambers fed by conduits 107 and 108 and the jack has a rod terminated by a threaded portion permitting the attachment of the plate 102. The plate 102 can bear laterally against members 106 fixed to the walls of the casing 101 in order to eliminate application of forces normal to the rod of the piston 105 due to the tension F in the strip 2.

Figure 8A:
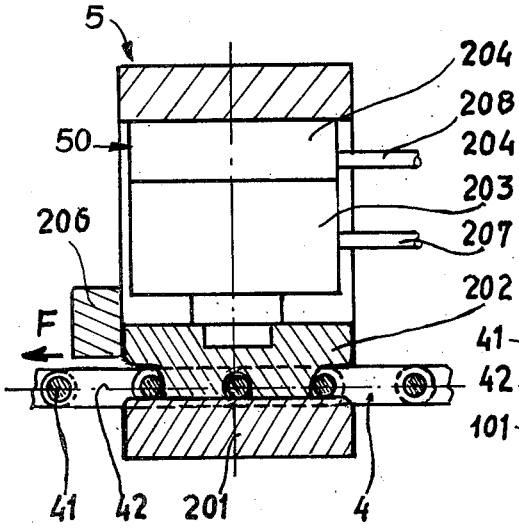
FIG. 8A is a sectional view taken along line 8A—8A in FIG. 8.
Figure 8:
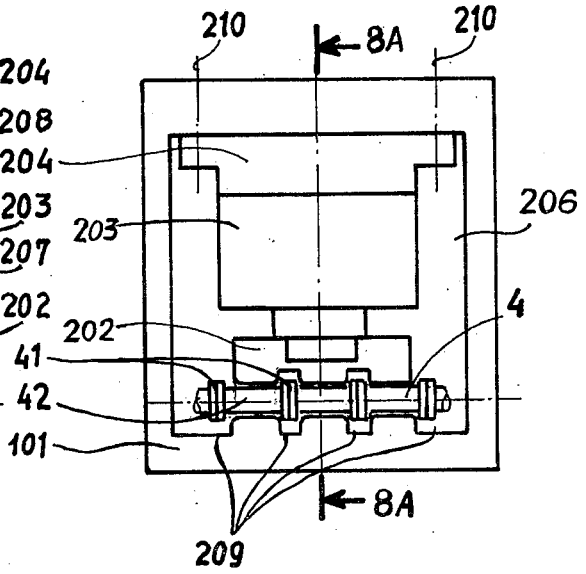
FIG. 8 is an elevation view of a locking assembly on the bearing belt.

In operation, the double action jack causes the jaws to clamp against and immobilize the strip 2 when the conduit 108 is fed from a high pressure pump and the conduit 107 is connected to a tank (without pressure). The fluid pressure must be sufficient so that the clamping force will be great enough to prevent any slippage of the strip 2 under the traction force F. FIG. 8 shows the construction of clamp member 5 secured to the frame 3 for clamping against the belt 4. Clamp member 6 is of the same construction except it is connected to jack 60. The clamp 5 and 6 members are constructed in a fashion analogous to clamp members 7 and 8 and comprise jaws actuated by jacks placed in a casing 201. The control jack 50 is supported by the upper wall of the casing and actuates an active jaw 202. In the construction shown in FIG. 8, the belt 4 is constituted by a chain, and jaw 202 is provided with teeth which project between rollers 41 of the chain. As in the construction of clamp 7, a fixed member 206 is secured to the wall of the casing to resist the traction force F applied to the chain. The clamp member 6 is of the same construction and is actuated by jack 60.

Hence, winding of the strip and simultaneous control of its tension are produced by successive stepwise displacements of the frame 3 as will be described hereafter (the arrows indicate the directions of movement). FIG. 3 shows the positions of the different members before a displacement of the frame. The clamp member 5 and the clamp member 7 are respectively locked onto the belt 4 and onto the strip 2. By means of the jack 61 the clamp member 6, which is open, is extended along the belt 4 towards the point of re-engagement of the belt with the wall 14 while the clamp member 8, which is also open, is retracted by the jack 81 along the strip 2 to move away from the point of contact of the strip 2 with the wall of the cylindrical body 1.

The clamp members 6 and 8 are then locked onto the belt 4 and the strip 2 respectively, whereupon the clamp members 5 and 7 are released. The jack 61 is then retracted and since the belt 4 is fixed, the frame 3 is displaced in a direction clockwise around the body 1 thus causing winding of the strip onto the body. The jack 81 is carried along the displacement of the frame and the clamp member 8 must be displaced in the opposite direction to the direction of winding, that is to say, towards the point of contact of the strip 2 with the wall of the body 1 to effect the payout and winding of the strip on the body. With the displacement of the frame 3 around the body there corresponds a speed of displacement of the clamp member 8 for which winding of the strip would be effected without tension. In this respect, if the piston of the jack 81 were to freely displace in the cylinder of the jack 81 during travel of frame 3 around body 1, the strip 2 would be payed out without being under tension. If the displacement of the piston of the jack 81 is braked, a restraining force is introduced which determines the tension in the strip. Stated otherwise, the relative rates of retraction and extension of the jacks 61 and 81 will determine the tension in the strip.

Figure 4:
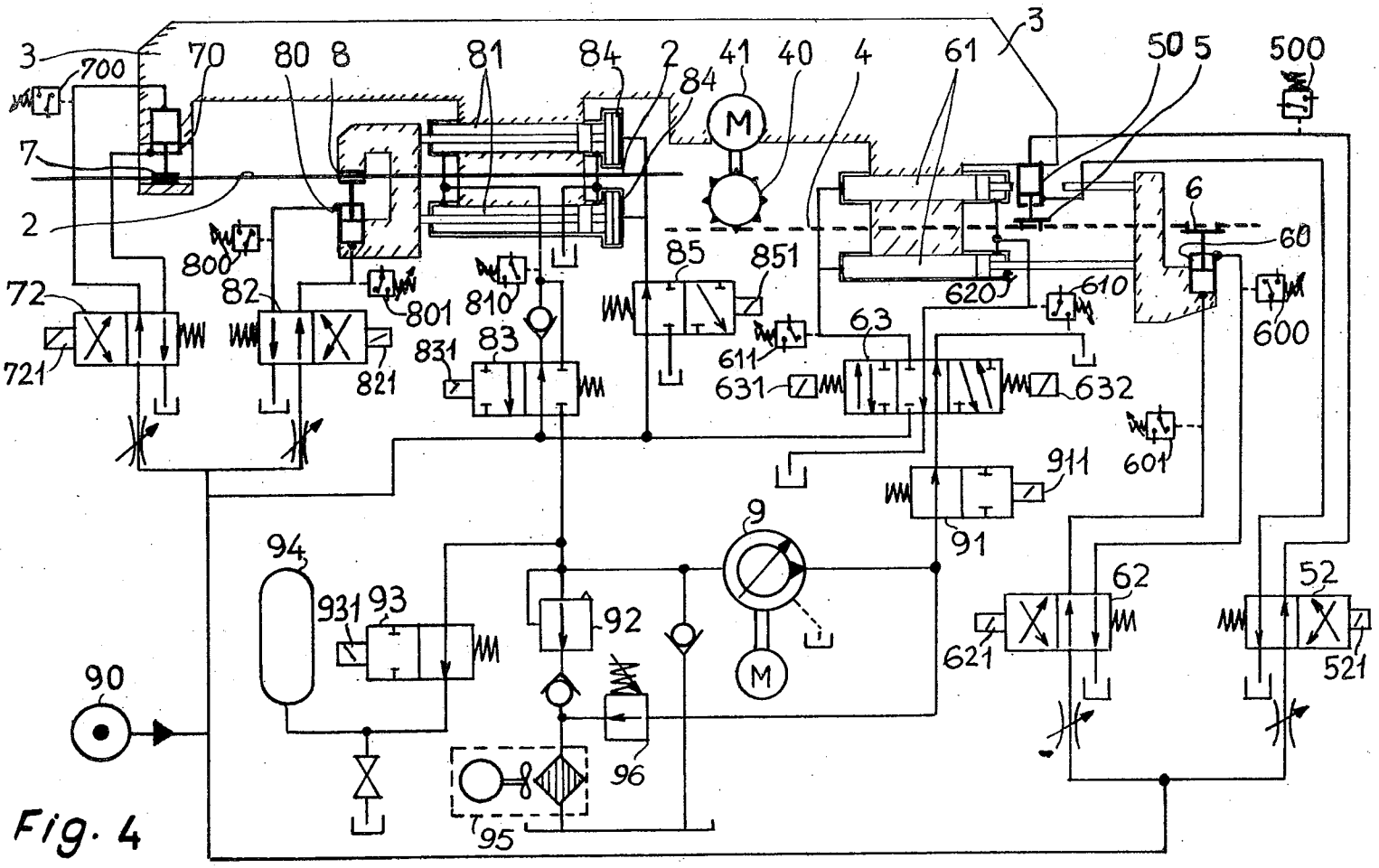
FIG. 4 is a hydraulic circuit of the winding device of FIG. 1.

It will be understood that the employment of hydraulic jacks is particularly suited to the control of the tension. FIG. 4 gives, by way of example, a diagram of the hydraulic circuit for operation of the device.

In FIG. 4, the frame 3 has been shown in a purely symbolic fashion and it can be seen that the displacement jack 61 and the strip restraining jack 81 are each composed of a pair of jacks arranged parallel to one another so as to eliminate any risk of bening of the rods of the jacks.

The clamp members 5 and 6 for engaging the belt 4 are actuated respectively by jacks 50 and 60, and the clamp members 7 and 8 for engaging the strip 2 are actuated respectively by the jacks 70 and 80.

In FIG. 4, the jacks 61 and 81 are shown in the position which they occupy before a displacement of the frame, the clamp member 5 and the clamp member 7 which are attached to the frame 3 being locked respectively on the belt 4 and on the strip 2.

The displacement of the apparatus is controlled by a hydraulic power system comprising a variable-flow oil pump 9 driven by a motor, the output of the pump being connected to a pressure-limiter 96. The pump 9 is connected to a return tank by a suction pipe but in service is fed by the delivery from the jacks 81. The pressure in jacks 81 is regulated by a remote-controlled pressure regulator 92 of any suitable conventional construction such as a pilot-controlled pressure regulator. In the form of a valve-controlled throttle. In addition, the delivery line from the jacks 81 is connected by way of an electrically-controlled valve 93 to a hydropneumatic accumulator 94. The oil return to tank is cooled by means of a cooler 95 shown diagrammatically in FIG. 4.

All the operations of locking of the clamp members 5,6,7 and 8 and of extending the jacks 61, 81 at the end of a displacement are controlled by an auxiliary low-power hydraulic pump unit 90 by means of electrically-controlled valves 52, 62, 72 and 82 respectively for the auxiliary jacks 50, 60, 70 and 80, and electrically-controlled valves 63 and 83 respectively for the jacks 61 and 81.

The electrically-controlled valves are conventional spring-biassed electromagnetic spool valves and are shown schematically and when the coils thereof are excited their spools are displaced. All the spools of the valves are shown in FIG. 4 in non-excited position of the coils. When the coil of a valve is excited, the spool is displaced to establish the different connections of the conduits for which the direction of the arrows indicate the direction of the fluid passage through the valve.

For automatic sequence, the valves are controlled by a programmer which can effect the operations one after another, the subsequent operation only being effected when the previous operation is terminated. In this respect, pressure switches 500, 700, 600, 800, 610, 601, 801, 611, 810 are installed in the different oil circuits. Their operation will be explained more fully later. An end-of-travel switch 620 is closed when the jacks 61 are in retracted end-of-travel positions.

Figures 5, 5A:
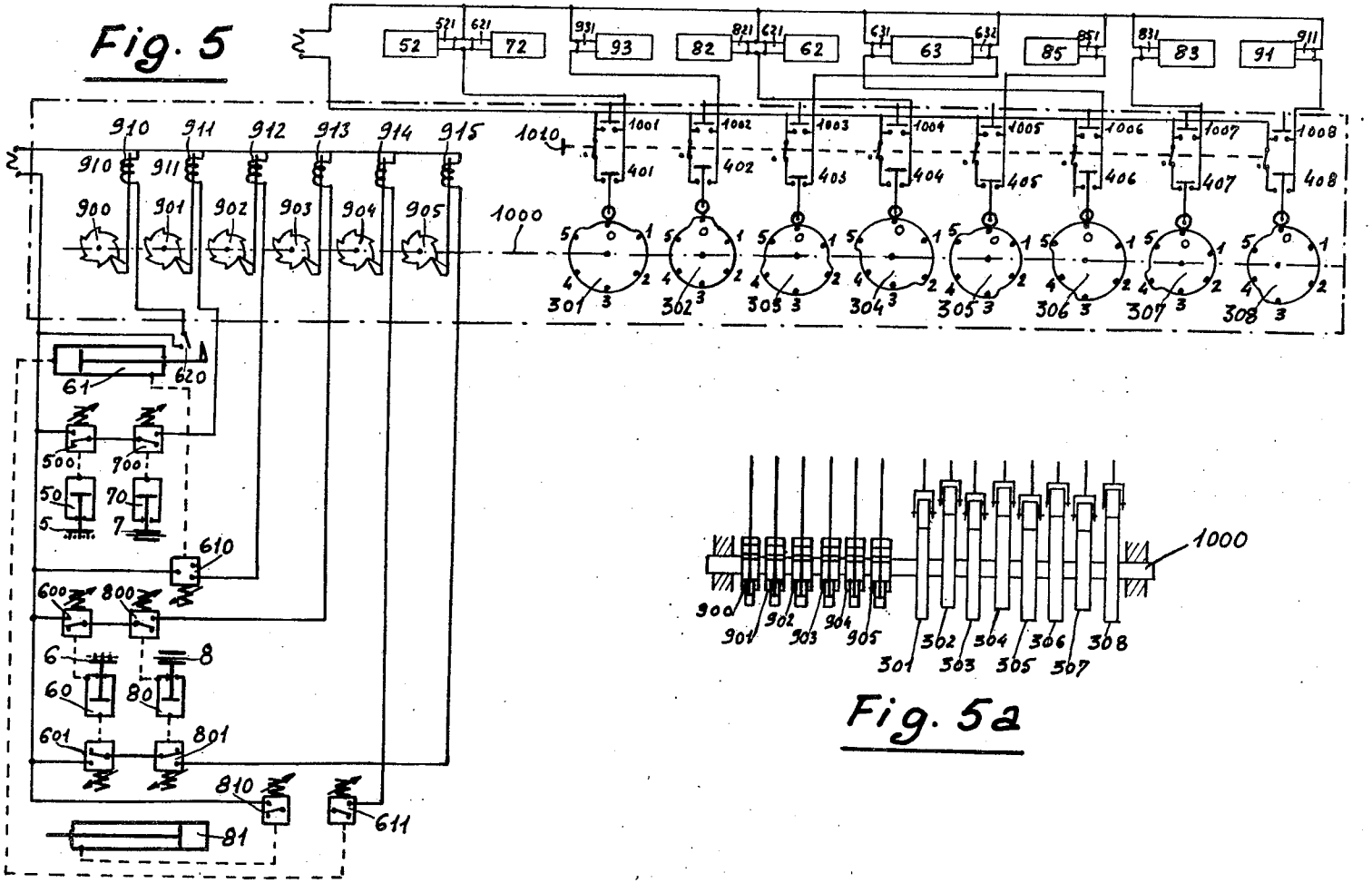
FIG. 5 is a diagrammatic illustration of a programmer for automatic operation of the apparatus.
FIG. 5*a* is a side view of a portion of the programmer.

FIG. 5 schematically shows, by way of example, a programmer controlled by an assembly of ratchets and cams which are spaced apart on an axle 1000 and which include six sprocket wheels 900, 901, 902, 903, 904, 905 driven through one-sixth of a rotation each time that the coils of electromagnets 910, 911, 912, 913, 914 and 915 are excited thus actuating the drive pawls of the wheels.

Eight cams 301, 302, 303, 304, 305, 306, 307, 308 are mounted on axle 1000 and each of the cams opens or closes an electrical circuit via switches 401, 402, 403, 404, 405, 406, 407, 408 whose control rollers bear on each of the respective cams. When the control roller is in a hollow of the respective cam, the circuit is closed (the current excites the coil of the corresponding valve). When the control roller is raised by the cam, the circuit is opened (the coil of the valve is not excited and the spool of the corresponding valve is found in the position of FIG. 4).

A multiple switch having two positions controlled by a rod 1010 permits the elmination of the switches 401–408 to permit the individual control of each valve by means of manual switches 1001–1008.

In FIG. 5 the sprocket wheels and the cams have been shown in a zero position corresponding to the displacement phase of the frame.

The programmer effects the automatic operation of the machine in the following manner.

The cam 301 controls the excitation of the valves 52 and 72: (immobilization of the strip 2 with respect to the frame 3 and immobilization of the frame 3 with respect to the belt 4 when the coils of the valves are not excited, and release when the coils are excited).

The cam 302 controls the actuation or release of the hydropneumatic accumulator 94. The accumulator is connected in circuit when the coil of the valve 93 is not excited. The accumulator is by passed and outside the circuit when the coil of the valve 93 is excited.

The cam 303 controls the valve 63 which effects the retraction or the stoppage of the jacks 61; when coil 632 is excited the jacks 61 are retracted; when the coil 632 is not excited, the jacks are at rest.

The cam 304 controls the jacks 80 and 60 through the intermediary of valves 62 and 82; when the coils of valves 62 and 82 are excited, the clamp members 6 and 8 are released; in the contrary case, the clamp members 6 and 8 are locked.

The cam 305 controls the actuation or placement of the abutments of the jacks 84; when the coil of valve 85 is excited, the abutments are removed; when the coil of valve 85 is not excited, the abutments are operatively in place.

The cam 306 controls the valve 63; when the coil 631 of this valve is excited, the rods of jacks 61 are extended (it is not possible to simultaneously excite the coils 631 and 632 of the valve 63).

The cam 307 controls through the valve 83 the retraction of the jacks 81 and their actuation in operation with a regulated oil pressure. When the coil of valve 83 is excited, the cylinders 81 apply a constant force on their rods whereas when the coil is not excited, the pump 90 effects retraction of the jacks 81 (which are extended almost completely at the end of travel at the time of winding when the jacks 61 are retracted and effect displacement of the frame 3).

The cam 308 acts on the valve 91; if the coil of the valve 91 is excited, the valve 63 is not fed by the pump 9; the valve 63 is fed in the opposite case.

The operation of the programmer will be explained later in the general description of operation of the machine which will follow.

DESCRIPTION OF THE OPERATION

1. Advance of the winding machine

Before the beginning of the operation, it is possible to place the machine in a position for its operation by operation of a reversible motor 41 driving a gear meshing with the chain 4. For example, the guide wheel 40 can be constituted as a gear driven by motor 41. A manual control is employed and the frame 3 is placed in its starting position.

The auxiliary pump unit 90 is then started up. By energizing the coils of the valves 52, 62, 72, 82 the clamp members 5 and 6 and the clamp members 7 and 8 are released.

At the ends of the two jacks 81 are situated jacks 84 whose rods act as end-of-stroke stops. The jacks 84 are actuated under the control of valve 85.

The pressure of the regulator 92 is adjusted in order to obtain an initial tension in the strip 2 as permitted by its anchor-members.

The jacks 81 are fed by the auxiliary pump unit 90 and are retracted until brought to a stop against the rods of the end-of-stroke jacks 84 which have been connected to tank by energizing the valve 85 and are thus retracted.

By energizing coil 631 of the valve 63, the rods of the jacks 61 are extended. The accumulator 94 is connected in circuit by the valve 93 whose coil is not energized. The accumulator ensures filling of the pipes and damps possible variations in pressure in the circuit.

The strip extends along a path from the storage reel 20 to the point of attachment with the body 1, passing over the guide pulleys 21, 22, 23 and between the jacks 81 and the jaws of the clamp members 7 and 8. The end of the strip is secured to the body 1 by any known means of anchorage.

By energizing the coil 632 of valve 63 instead of coil 631, the jacks 61 are connected to the delivery circuit of the pump 9. It is then possible to start winding. For this purpose, the excitation of the coils of the valves 62 and 82 is terminated in order to effect locking of the clamp members 6 and 8 respectively onto the belt 4 and onto the strip 2. The motor is started and the pump 9 is progressively pressurized. In order to avoid jerks in the unwinding of the strip 2 from the supply reel 20, motors 25 and 26 control the rotation of the reel 20 and the arm 32 around the axle 10 at an average speed.

Upon retraction of the jacks 61, displacement of the frame 3 commences and the pressure rises in the jacks 81 which oppose this displacement. The tension in the strip increases up to the predetermined value regulated by the pressure regulator 92. As the frame 3 undergoes displacement, the cylinders of the jacks 81 travel with the frame 3 and the rods of the jacks 81 undergo extension from the cylinders in relation to the pressure in the jacks 81 as established by the pressure regulator 92. The jacks 81 thus serve as a braking means for opposing payout of the strip 2 so that the strip is wound with a pre-determined tension on the body 2. It is possible to transfer to automatic operation when the jacks 61 are at the end of their retracted travel. The jacks 81 are then extended but there still remains a certain length of stroke. The end-of-stroke jacks 84 connected to tank remain retracted.

2. Automatic operation

The unwinding of the strip can now be effected by successive stepwise displacements of the carriage 3 according to the operation whose different steps are shown in FIGS. 6A–6F where only the active members of the apparatus in the assembly in FIG. 3 are shown.

Figure 6A:
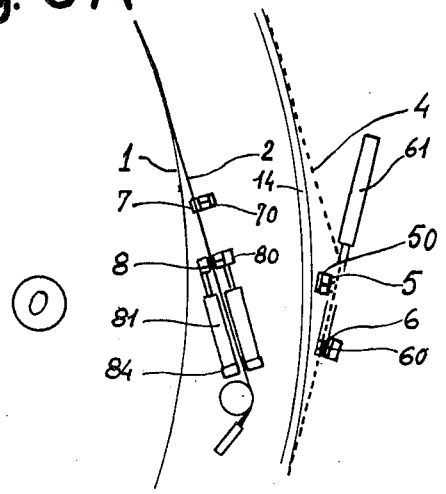
FIGS. 6A–6F schematically show the different steps of the winding operation and respectively correspond to cam positions 0–5 in FIG. 5.

Therefore, in FIG. 6A–6F are seen:

- the cylindrical body 1 on which the strip 2 is wound and the cylindrical wall 14 on which the belt 4 is supported;
- the clamp member 5 fixed to the frame (not shown) and the clamp member 6 fixed to the extremity of the rod of jack 61,
- the clamp member 7 fixed to the frame (not shown) and the clamp member 8 fixed to the extremity of the rod of the jack 81, In FIG. 6A the machine is in operation and it winds the strip around the cylindrical body; the programmer is in the zero position (of cams 301–308) as shown in FIG. 5.

The clamp member 5 and the clamp member 7 are open since the coils of the valves 52 and 72 are excited (switch 401 is closed).

The hydropneumatic accumulator 94 is connected in circuit since the coil 931 of the valve 93 is not excited.

The jacks 61 are retracting since the coil 632 of the valve 63 is excited.

The clamp member 6 and the clamp member 8 are locked on belt 4 and strip 2 respectively since the coils 621 and 821 of the valves 62 and 82 are not excited.

The stops 84 are retracted since the coil 851 of the valve 85 is excited.

The coil 631 of the valve 63 is not excited (the coil 632 is excited).

The coil 831 of the valve 83 is excited and the tension in the strip is controlled by the pressure of the control oil in jack 81 under the action of pressure regulator 92.

The valve 91 is not excited and the valve 63 is fed thus to produce displacement of the frame 3 by the jacks 61.

When the jacks 61 arrive at the end of travel (retracted), the end of travel switch 620 is acted on by the displacement of the rods 61 to be closed and the coil 910 effects the drive of the sprocket wheel 900 over one-sixth of a revolution to drive the programmer to position 1 causing the cams 301–308 to have turned one-sixth of a revolution in the counter clockwise direction and points 1 of the cams are under the rollers of switches 401–408. The machine is then in the position in FIG. 6B.

Figure 6B:
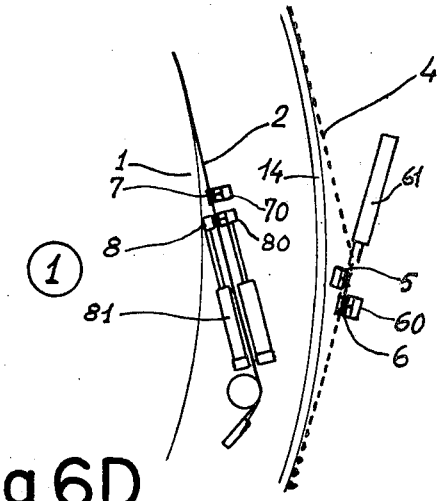

In FIG. 6B the machine is stopped.

The operations controlled by the cams in the position in FIG. 6B are the following:

- the clamp members 5 and 7 controlled by the auxilary hydraulic unit 90 are closed by the cam 301; the frame 3 is at rest: valves 52 and 72 are not excited;
- the cam 302 effects the excitation of the coil 931 of the valve 93 which disconnects the accumulator 94 from the circuit and closes the conduit for flow of the jacks 81 which thus remain pressurized and blocked.

The cams 303–307 do not modify anything, the clamp members 6 and 8 therefore remaining locked on belt 4 and strip 2 respectively.

Figure 6C:
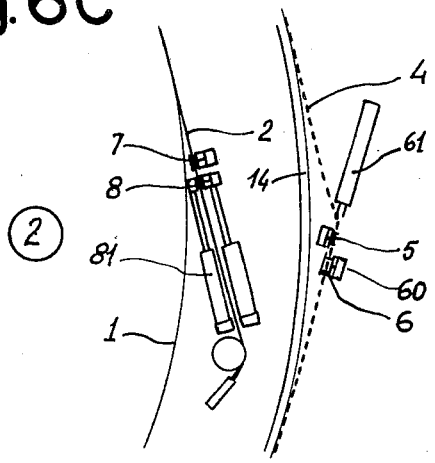
Figure 6D:
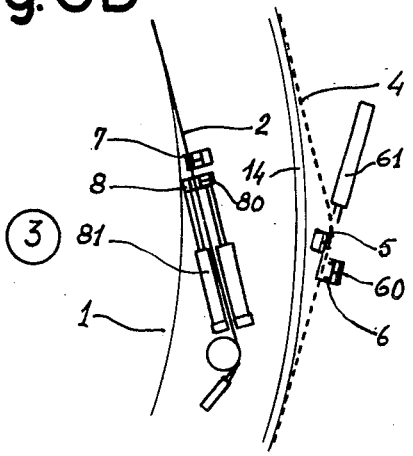

When the clamp members 5 and 7 are locked, the oil pressure exerted on the rods of jacks 50 and 70 increases and two manostats or pressure switches with contacts 500 and 700 mounted in series and placed on the feeds close their circuits which feed the coil 911 controlling the sprocket wheel 901 which turns through one-sixth of a turn driving the programmer to position 2 as represented in FIG. 6C.

Position 2 corresponds to a pressure drop in the jacks 61. In fact, the cam 303 de-energizes the coil 632 and the valve 63 comes to middle position.

The coil 631 being not energized (cam 306), the jacks 61 are no longer pressurized but remain with rods in retracted position.

Clamp members 5–6 and 7–8 remain locked (cams 301 and 304).

The accumulator 94 remains outside the circuit (cam 302). The coil 831 of valve 83 remains energized (cam 307). The jacks 81, which are blocked, keep on exerting their pulling effort on strip 2.

When the oil pressure has come down to zero in the jacks 61, on rod side, a pressure-switch 610, placed on the supply line to jacks 61 on rod side, closes the circuit feeding the coil 912 of wheel 902 which drives the shaft 1000 through one-sixth of a turn, with the cams coming to the position 3.

Position 3 corresponds to the opening of the clamp members 6 and 8.

In fact, by the cam 306, the coils 621 and 821 of valves 62 and 82, respectively, are energized and control the opening of the clamp members 6 and 8.

The end-of-stroke jacks 84 fed by the valve 85 of which coil 851 is no longer energized (cam 305) and the end-of-stroke stops of the jacks 81 are set in position; these stops are provided to limit the retracting stroke of the jacks 81. This stroke limit will be required for a further operating cycle; in fact, it is necessary to tighten the strip again between the clamp members 7 and 8 before releasing the clamp member 8.

At the end of opening of the clamp members 6 and 8, the pressure increases in the jacks 60 and 80 on the side of the rod and the manostats 800 and 600 mounted in series in the circuit of the coil 913 close their circuits; the coil 913 is then excited and produces rotation of one-sixth of a turn of the sprocket wheel 903. The operation then passes to the condition shown in FIG. 6E where the cams of the programmer are in position 4.

Figure 6E:
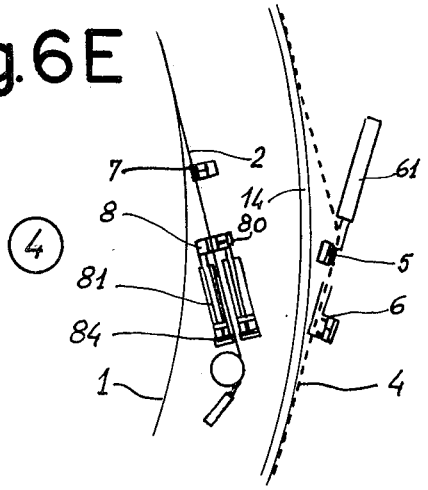

In the position in FIG. 6E, the jacks 61 are extended and the jacks 81 are retracted until they abut against jacks 84.

The coil 631 of the valve 63 is excited, the circuit 406 being closed (by cam 306) and the coil 831 of the distributor 83 is no longer excited, the switch 407 being open (by cam 307); the jack 61 fed by the auxiliary pump unit 90 in the direction of extension (which is possible since the clamp member 6 is released) and the jacks 81 are retracted to their stops.

The coil 911 is excited (by cam 308) and the valve 91 cuts the feed from the pump 9 through the valve 63.

When the jacks 81 come to bear against the abutments established by the jacks 84 and the jacks 61 are extended, the feed pressure of the jacks 81 increases and the two contact switches 611 and 810 mounted in series in the circuits feeding the jacks 61 and 81 then close the circuit of the coil 914 controlling the drive of the sprocket wheel 904. The axle 1000 then turns through one-sixth of a revolution and passes to the position in FIG. 6F corresponding to the 5 position of the cams of the programmer.

Figure 6F:
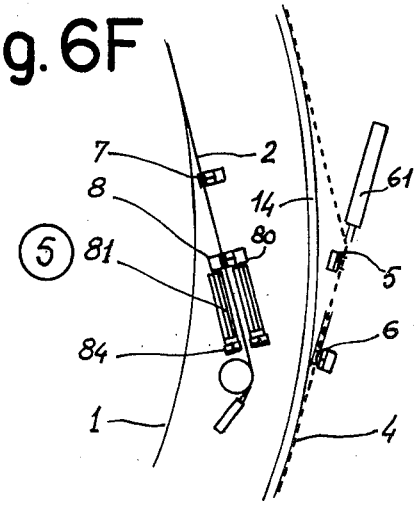

In the position in FIG. 6F the clamp members 6 and 8 are engaged with belt 4 and strip 2 respectively.

The cam 303 effects the excitation of coil 632 of the valve 63 while the cam 306 cuts the excitation of coil 631. The valve 63 is then placed in the position for feed of the jacks 61 from the main pump 9 which, however, remains isolated by the valve 91 whose coil 911 is excited by cam 308.

The cam 304 cuts the excitation of the coils 621 and 821 of the valves 62 and 82 which return to the position of FIG. 4 and effect the closure respectively of the clamp members 6 and 8 on belt 4 and strip 2.

When the clamp members 6 and 8 are closed, the pressure on the side opposite the rods of the jacks 60 and 80 increases and the contact switches 601 and 801 close and the coil 905 is energized which produces rotation of the sprocket wheel 905 and the passage of the programmer to the 0 position corresponding to FIG. 6A.

When the position in FIG. 6A has been reached again, the jacks 81 put the strip 2 under tension between the clamp members 7 and 8 whereafter the clamp member 7 and the clamp member 5 are opened and the jacks 61 produce advance of the carriage.

In this regard, the cam 305 closes the excitation circuit of the coil 851 which releases the stops 84 and permits a slight retraction of the jacks 81 slightly before the cam 301 closes the excitation circuit of the coils 521 and 721 which produces the respective opening of the clamp members 5 and 7.

The cam 308 then cuts the excitation of the coil 911 so that the valve 91 connects the pump to the feed circuit of the jacks 61 to produce advance of the carriage by the retraction of jacks 61 and a new cycle begins, the tension maintained in the strip by the jacks 81 being controlled by the pressure regulator 92.

When the length of the strip wound on the body is sufficient so that the traction force on its anchorage does not exceed its permissible value, the tension is increased by acting remotely on the pressure regulator 92 until the strip is stretched to the predetermined value.

Thus, by successive stepwise cycles, the desired length of the strip is wound on the body under a controlled tension.

At the end of the winding, the speed is reduced by diminishing the output of the pump 9. At a determined distance from the point of final anchoring, the tension is reduced by acting on the regulator 92 in a manner to limit the force on the anchorage to an acceptable value.

Then the end of the strip is attached to the body by any suitable means, e.g. glueing, riveting, welding, etc.

For example, a means of anchorage is described in French Pat. No. 2,333,742.

Next, the tension is brought back to zero and the motors of the pump 9 and of the auxiliary pump 90 are stopped, and excess strip beyond the outer anchorage is cut off.

The invention is not intended to be restricted to the details of the embodiment which has just been described. On the contrary, by applying the same principles and by employing equivalent means, numerous variants may be conceived. Thus, the belt may be other than a chain and the clamp members may have other forms than those described.

Similarly, other means of control of the displacement and of the control of the tension may be employed and the use of hydraulic circuits is not imperative.

Finally, while the device has been described in connection with the winding of a high-strength ribbon in superimposed layers, the device may be employed for carrying out helicoidal winding with contiguous or spaced turns, since it would be sufficient then to control displacement of the frame in parallel with the axis of the cylindrical body. Also the device may be used to wind other elongate members such as metal wires or cables on the body.

In addition, although the device described above is designed for winding ribbons onto a cylindrical body of revolution, the device may easily be adapted, if the need arises, to the reinforcement of a body which is not a body of revolution. It is, in fact, sufficient that the frame follow a guidewall parallel with the wall of the body or bear directly against the wall of the body.

What is claimed is:

1. A device for winding an elongate member under tension onto a body, said device comprising:

a frame;

guide means for guiding the elongate member to the body;

means mounting said guide means on said frame;

means for maintaining said frame at a constant distance from the body;

means for displacing said frame around the body to wind said elongate member onto the body; and means for controlling the tension in the elongate member as it is wound on the body;

said frame displacing means including:

a belt surrounding said body and fixed against rotation relative thereto;

first and second means for selectively engaging or releasing said belt, each of said first and second means being selectively movable relative to said belt when released from said belt, means mounting said first belt engaging means on said frame in fixed relation thereto; and means mounting said second belt engaging means on said frame for moving said second belt engaging means relative to said frame in the direction of winding of said elongate member when said first belt engaging means engages said belt and in the opposite direction when said second belt engaging means engages said belt.

2. A winding device as clsimed in claim 1, wherein said tension controlling means comprises first and second means for selectively engaging or releasing the elongate member, each of said first and second elongate member engaging or releasing means being relatively movable with respect to the elongate member when released therefrom, means mounting said first elongate member engaging means on said frame in fixed relation thereto; and means mounting said second elongate member engaging means on said frame for moving said second elongate member engaging means relative to said frame in synchronism with movement of said second belt engaging means such that said second elongate member engaging means is moved in the direction of winding of the elongate member simultaneously with movement of said second belt engaging means in said winding direction and when said first elongate member engaging means is engaged with the elongate member said second elongate member moving means is released from said elongate member and is moved in the opposite direction simultaneously with movement of said second belt engaging means in said opposite direction.

3. A winding device as claimed in claim 1, wherein said means for moving said second belt engaging means includes at least one hydraulic jack which is hinged to said frame and carries said second belt engaging means.

4. A winding device as claimed in claim 2, wherein said means for moving said second elongate member engaging means includes at least one hydraulic jack which is hinged to said frame and carries said second elongate member engaging means.

5. A winding device as claimed in claim 4, including means for positive control of movement of said second elongate member engaging means in the direction of winding while said frame is at rest, said means for controlling the tension in the elongate member as it is being wound on the body comprising means for control of the speed of movement of said second elongate member engaing means in the direction opposite winding while said frame is undergoing movement, including a valve means for limiting the pressure in said jack to a predetermined value for tensioning said elongate member.

6. A winding device as claimed in claim 4, including a removable stop means for limiting displacement of said second elongate member engaging means in the direction of winding, and means for removing said stop means after said second elongate member engaging means is engaged with said elongate member to enable a supplementary displacement of said second elongate member engaging means for tensioning the elongate member.

7. A winding device as claimed in claim 1, wherein said belt comprises a chain which is fixed against rotation by friction against the body.

8. A winding device as claimed in claim 1, comprising means for sequentially operating said first and second belt engaging means to cause said frame to undergo advancement around said body in successive steps.

9. A winding device as claimed in claim 8 wherein said means for moving said second belt engaging means comprises jack means hingeably connected to said frame and having extended and retracted positions, said second belt engaging means being mounted on said jack means and being engaged with said belt with said jack means in extended position, said frame undergoing movement through one step as said jack means goes from extended to retracted position.

10. A winding device as claimed in claim 9 wherein said means for controlling tension in said elongate member comprises first and second means for selectively engaging and releasing said elongate member, means mounting said first elongate member engaging means in fixed relation on said frame, and further jack means hingeably connecting said second elongate member engaging means to said frame for extended and retracted positions, said second elongate member engaging means being engaged with said elongate member with said further jack means retracted and with the first said jack means extended such that as said first jack means is retracted and the frame is advanced one step, said further jack means is forceably extended against the opposition of hydraulic pressure in said further jack means, and means for controlling the hydraulic pressure in said further jack means.

11. A method of winding an elongate member under tension onto a body, said method comprising:

guiding on a frame an elongate member to be wound on a body, surrounding the body with a belt which is fixed against rotation relative thereto, and advancing said frame around said body in successive steps of advancement by 1. locking to said belt an extensible and retractable member connected to said frame, the member being locked to the belt in extended position,
2. retracting the member while locked to the belt to advance the frame one step around the body,
3. releasing the member from the belt while clamping the frame to the belt,
4. extending said member to its extended position, and
5. releasing the clamping of the frame to the belt repeating operations 1–5 in sequence to continue the advancement of the frame around the body, winding said elongate member onto said body as said frame undergoes stepwise advancement around said body, and applying tension to said elongate member as it is being wound onto said body from said frame.

12. A method as claimed in claim 11 wherein tension is applied to said elongate member as it is being wound onto said body from said frame by applying a braking force on said elongate member as said frame is being advanced in steps around said body.

13. A method as claimed in claim 12 wherein said braking force is applied to said elongate member by engaging said elongate member and applying a restraining force to said elongate member as said frame is advanced and said elongate member is fed to said body.

14. A method as claimed in claim 13 wherein said elongate member is fed to said body under a resistance correlated with the advance of the frame to provide a predetermined degree of tension in said elongate member.

* * * * *